US011292562B2

(12) United States Patent
Tragatschnig

(10) Patent No.: US 11,292,562 B2
(45) **Date of Patent: *Apr. 5, 2022**

(54) DIVING DEVICE

(71) Applicant: Joerg Tragatschnig, Zell am See (AT)

(72) Inventor: Joerg Tragatschnig, Zell am See (AT)

( * ) Notice: Subject to any disclaimer, the term of this patent is extended or adjusted under 35 U.S.C. 154(b) by 142 days.

This patent is subject to a terminal disclaimer.

(21) Appl. No.: 16/626,948

(22) PCT Filed: Jun. 30, 2017

(86) PCT No.: PCT/EP2017/066265
§ 371 (c)(1),
(2) Date: Dec. 30, 2019

(87) PCT Pub. No.: WO2019/001726
PCT Pub. Date: Jan. 3, 2019

(65) Prior Publication Data

US 2020/0130793 A1 Apr. 30, 2020

(51) Int. Cl.
*B63C 11/20* (2006.01)
*B63C 11/18* (2006.01)
*B63C 11/22* (2006.01)

(52) U.S. Cl.
CPC ..... *B63C 11/207* (2013.01); *B63C 11/18* (2013.01); *B63C 11/20* (2013.01); *B63C 11/22* (2013.01)

(58) Field of Classification Search
CPC ..... B63C 11/18; B63C 11/186; B63C 11/20; B63C 11/202; B63C 11/205;
(Continued)

(56) References Cited

U.S. PATENT DOCUMENTS 3,050,055 A 8/1962 Vautin
4,022,201 A * 5/1977 Diggs ..... B63C 11/207 128/201.11

(Continued)

FOREIGN PATENT DOCUMENTS

EP 0 297 416 B1 9/1992
WO 02/051701 A1 7/2002

OTHER PUBLICATIONS

International Search Report in PCT/EP2017/066262, dated Sep. 22, 2017.

(Continued)

*Primary Examiner* — Colin W Stuart
(74) *Attorney, Agent, or Firm* — Collard & Roe, P.C.

(57) ABSTRACT

A diving device includes an air pump with a rigid housing including an interior and an opening closed by a sack-shaped flexible part to form a variable pump volume delimited by the housing and the flexible part. The air pump is designed such that if surrounding water causes overpressure, the flexible part is pressed into the interior, thereby reducing the pump volume, and rests against an inner wall of the housing at least partly in a contact section of the interior. The flexible part can be pulled out of the interior against the overpressure by the muscle force of a diver, thereby increasing the pump volume. The air supply line can be releasably secured to a support device, in particular a waist belt of the support device, centrally behind the back of the diver, and a quick ejection device is provided for releasably securing the air supply line.

16 Claims, 7 Drawing Sheets

(58) Field of Classification Search
CPC ..... B63C 11/207; B63C 11/14; B63C 11/16; B63C 11/22; B63C 11/02; B63C 11/52; B63C 2011/182; B63C 2011/2281; B63C 2011/306; B63C 2011/128; B63C 2011/026; A62B 7/00; A62B 7/02; A62B 7/12; A62B 9/00; A62B 9/04; A62B 18/00; A62B 18/006; A42B 3/04; A42B 3/0406; F16B 2200/30; F16B 12/125
USPC ..... 403/381
See application file for complete search history.

(56) References Cited

U.S. PATENT DOCUMENTS 4,348,976 A * 9/1982 Gilbert ..... A63B 35/12 114/315
4,877,167 A * 10/1989 McNemar ..... A45F 5/02 224/269
4,919,631 A * 4/1990 Stafford ..... B63C 11/202 114/315
5,092,327 A 3/1992 Tragatschnig
7,258,509 B2 8/2007 Ellwitz
2002/0166555 A1* 11/2002 Antonelli ..... B63C 11/207 128/201.11
2005/0000516 A1* 1/2005 Saillet ..... B63B 7/082 128/201.27
2010/0158605 A1* 6/2010 Gargaro, III ..... A01K 97/10 403/336
2011/0057009 A1* 3/2011 McLeod ..... A45F 3/14 224/660

OTHER PUBLICATIONS

International Search Report in PCT/EP2017/066265, dated Sep. 22, 2017.

* cited by examiner

Fig. 3
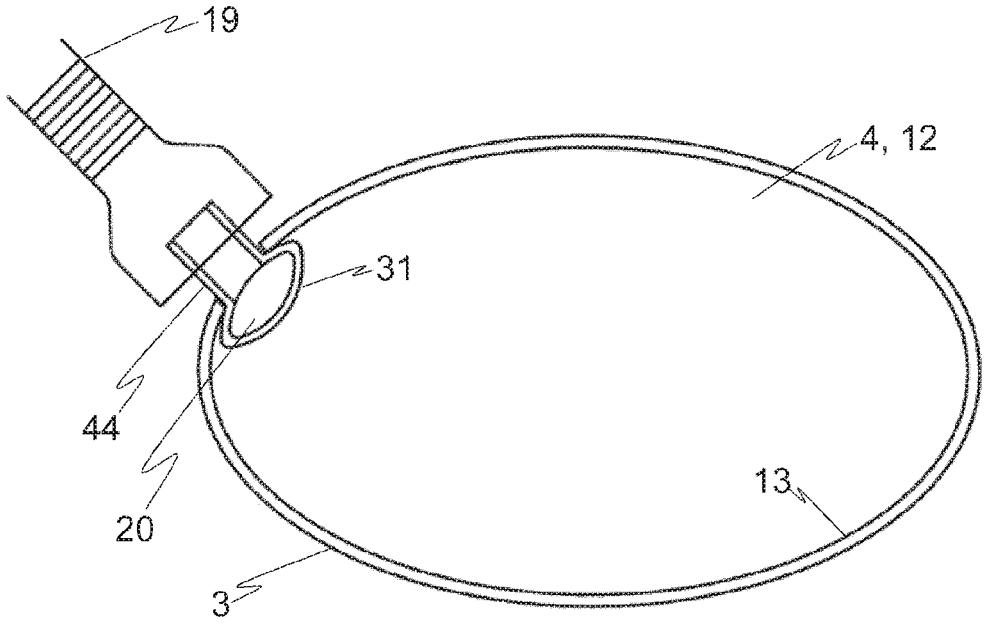
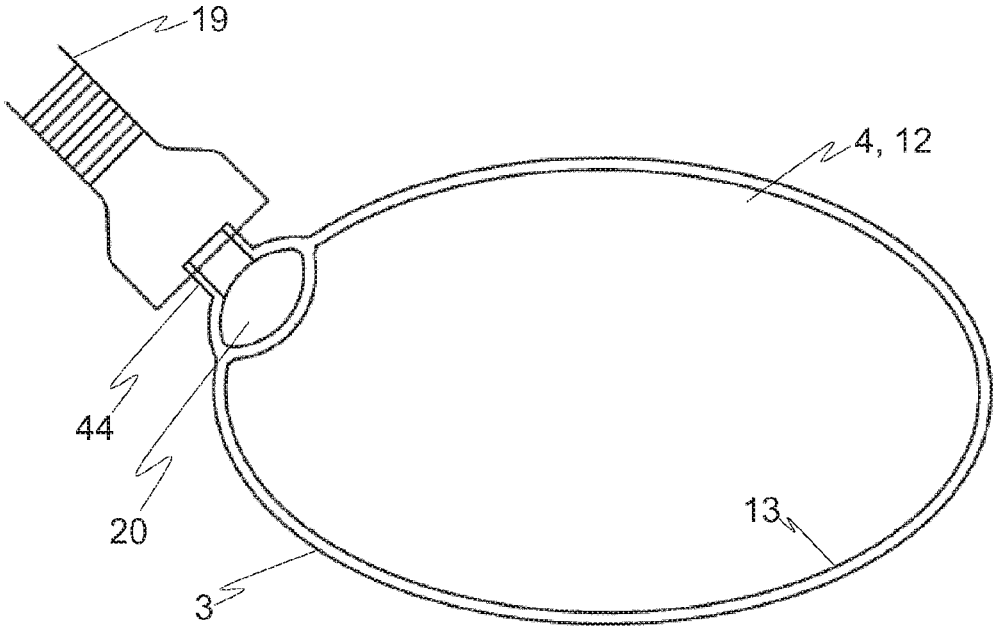
Fig. 4

Fig. 5
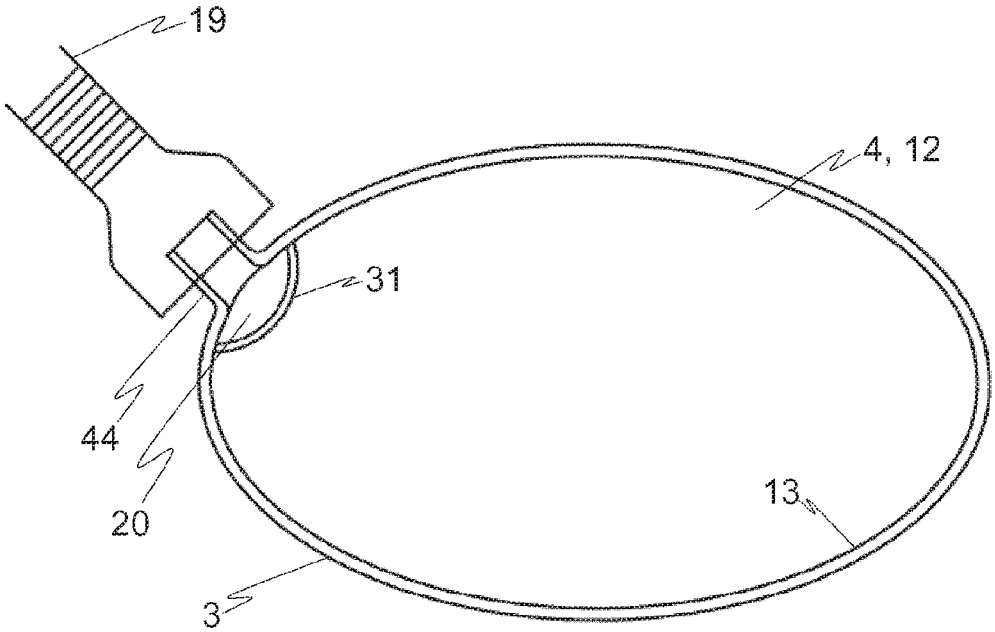
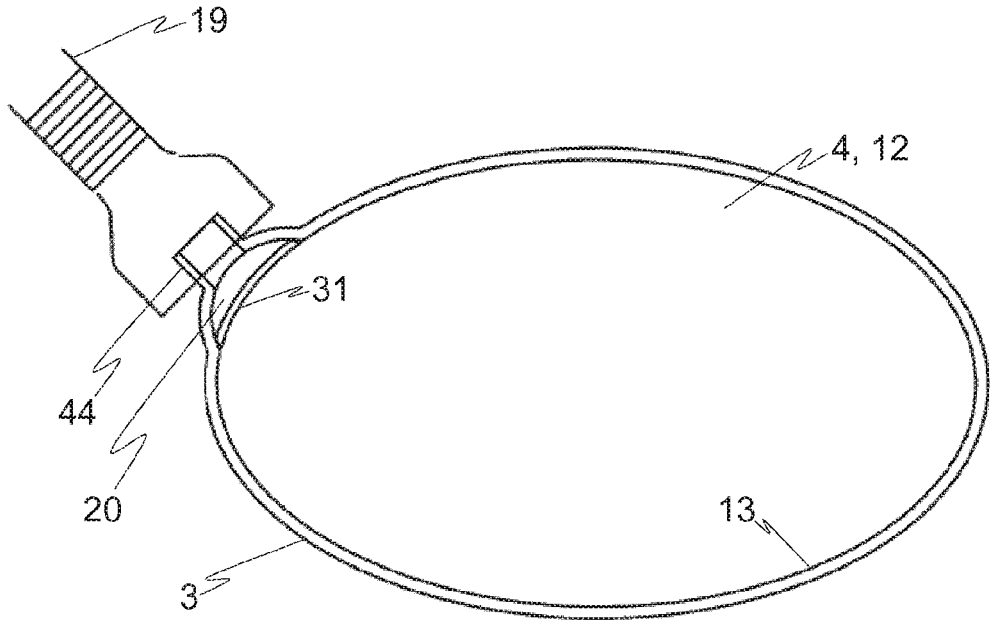
Fig. 6

Fig. 7
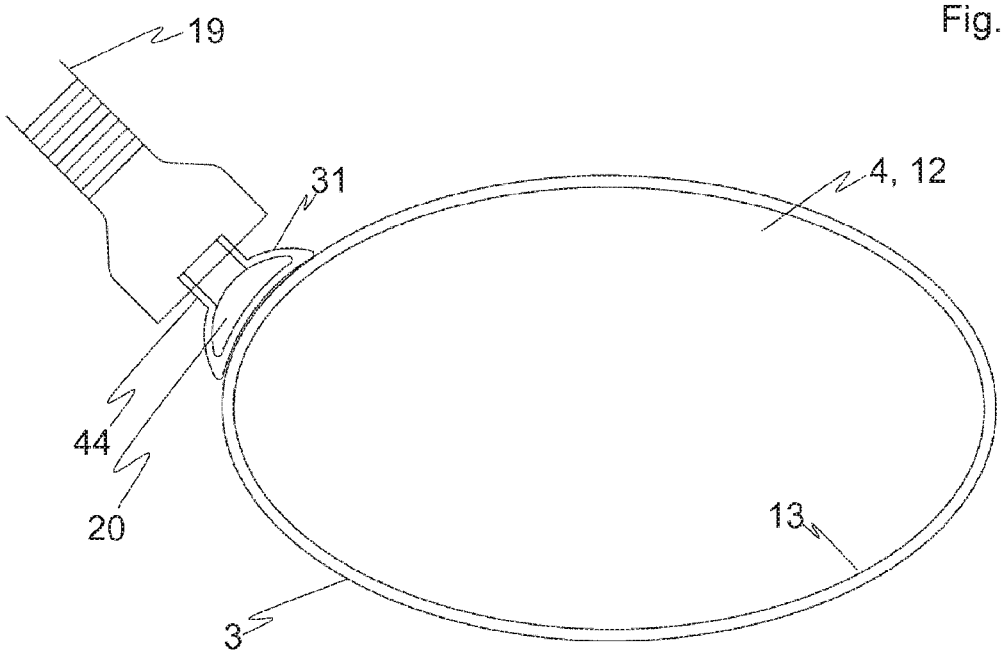
Fig. 9a
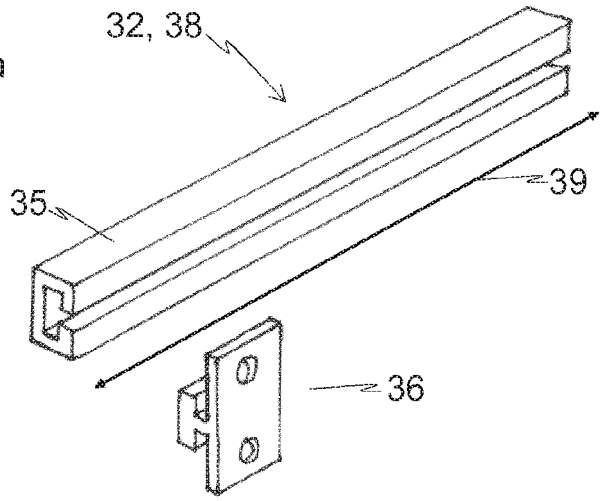
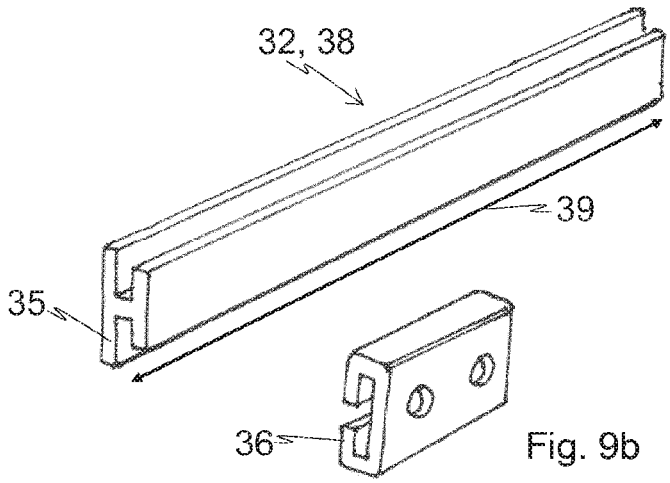
Fig. 9b

Fig. 8a
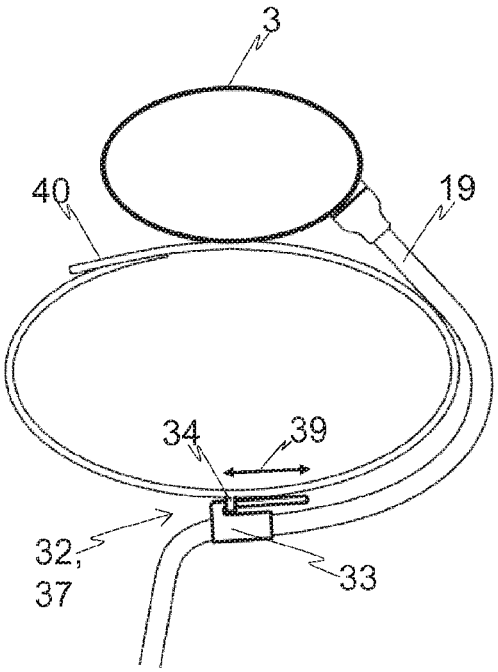
Fig. 8b
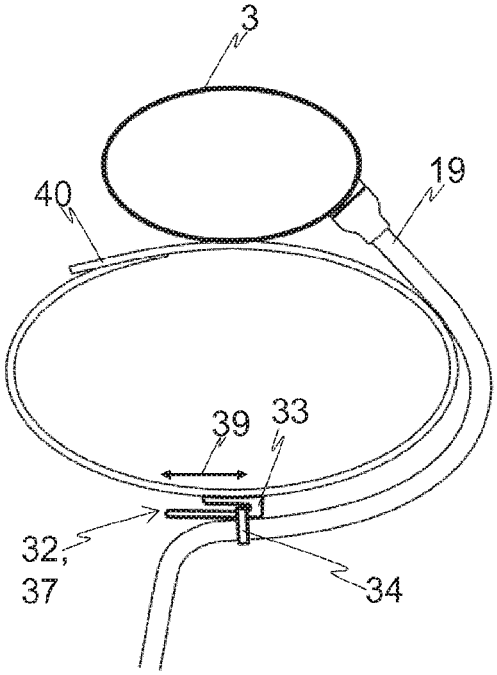
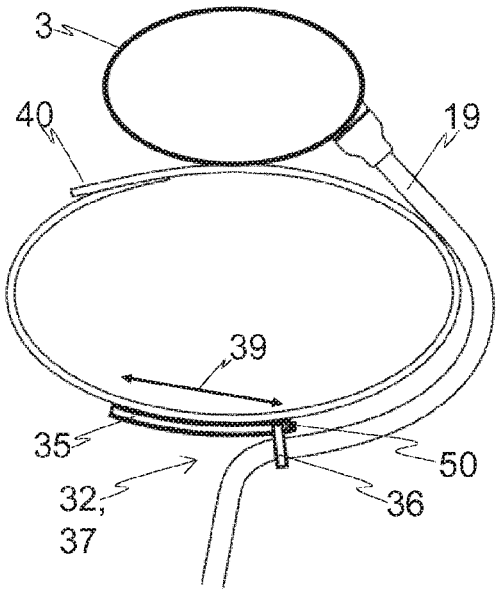
Fig. 8c
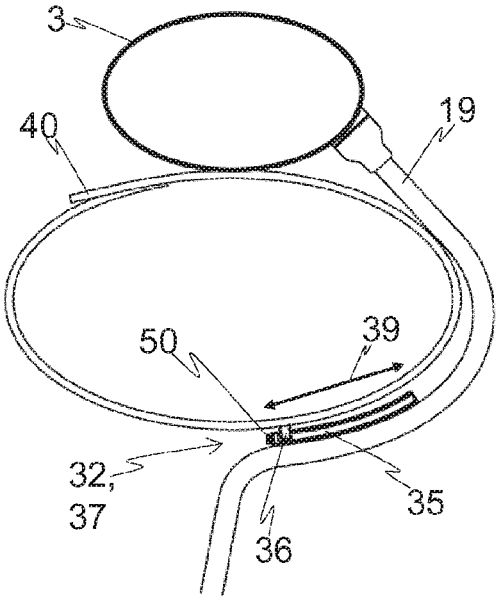
Fig. 8d

DIVING DEVICE

CROSS REFERENCE TO RELATED APPLICATIONS

This application is the National Stage of PCT/EP2017/066265 filed on Jun. 30, 2017, the disclosure of which is incorporated by reference. The international application under PCT article 21(2) was not published in English.

FIELD OF THE INVENTION

The invention relates to a diving apparatus comprising an air pump having a rigid housing with an interior space, which extends along a longitudinal axis of the housing from an interior-space beginning to an interior-space end and, disposed in a region of the interior-space end, an opening, which is closed by a bag-like flexible part in order to form a variable pump volume, which is bounded by the housing and the flexible part, wherein the air pump is designed in such a way that, in the event of an overpressure caused by surrounding water, the flexible part is pressed into the interior space, with reduction of the pump volume, and bears at least in portions on an inner wall of the housing in a contact portion of the interior space, in order to compress air in the pump volume and to supply it from a region of the interior-space beginning via a breathing line to a diver, wherein the contact portion extends along the longitudinal axis from the interior-space end in the direction of the interior-space beginning up to a maximum height, wherein the flexible part can be pulled out of the interior space against the overpressure by muscle power of the diver and with increase of the pump volume, in order to suck in air via an air-supply line from above a water level of the water, wherein furthermore a carrying device for fixation of the air pump in front of the chest of the diver is provided.

PRIOR ART

From the prior art, diving apparatuses are known that have an air pump, which can be connected to the body of the diver and operated by muscle power, and by means of which air can be sucked in from the atmosphere and compressed, wherein the compression is necessary due to the hydrostatic pressure even at shallow diving depths. Such diving apparatuses are usable for diving depths down to approximately 10 meters and are characterized by a simple construction and an easy-to-learn handling, wherein the diver is able to dive free of further technical auxiliary equipment such as compressed-air bottles or compressors. In particular, even the diving duration is not limited by the said further technical auxiliary equipment.

The most closely related prior art is to be regarded as the diving apparatus known from EP 0297416 B1, which comprises an air pump having a rigid housing with an interior space, which extends along a longitudinal axis of the housing from an interior-space beginning to an interior-space end and, disposed in a region of the interior-space end, an opening, which is closed by a bag-like flexible part in order to form a variable pump volume, which is bounded by the housing and the flexible part, wherein the air pump is designed in such a way that, in the event of an overpressure caused by surrounding water, the flexible part is pressed into the interior space, with reduction of the pump volume, and bears at least in portions on an inner wall of the housing in a contact portion of the interior space, in order to compress air in the pump volume and to supply it from a region of the interior-space beginning via a breathing line to a diver, wherein the contact portion extends along the longitudinal axis from the interior-space end in the direction of the interior-space beginning up to a maximum height wherein the flexible part can be pulled out of the interior space against the overpressure by muscle power of the diver and with increase of the pump volume, in order to suck in air via an air-supply line from above a water level of the water, wherein furthermore a carrying device for fixation of the air pump in front of the chest of the diver is provided. However, that diving apparatus suffers from a number of disadvantages. In particular, emergency situations may develop if the air-supply line becomes entangled or ensnared on an obstruction, for example when the diver is ducking under the obstruction. It may be very difficult and time-consuming for the diver to free himself from such a situation, which in conjunction with a possible panic of the diver may sometimes be life-threatening for him.

Furthermore, it is provided in this diving apparatus that the air-supply line (just as the breathing line) is to be attached to the housing in the region of the interior-space beginning and from there is routed over the shoulders of the diver. This means, however, that pulling forces, which act on the air-supply line and necessarily occur to a certain extent, since, during diving, the air-supply line is connected at its end pointing to the atmosphere with a buoy floating on the surface of the water and thus the buoy must be pulled along by the diver via the air-supply line during diving, do not act on the center of gravity of the diver. The consequence of this is that the diver would be subjected to rotation by the pulling forces, unless he actively works against the initiation of the rotational movement by appropriate movements. In particular, during forward swimming, the diver is therefore forced continuously out of his ideal, preferably horizontal diving position, by the fact that the upper body of the diver is being pulled upward.

In the known diving apparatus, a carrying device with shoulder straps is provided, in order to fix the air pump in front of the chest of the diver. This leads to a further disadvantage, however, since the pulling forces—which become progressively greater in a manner corresponding to increasing diving depth—to be applied for pulling out the flexible part must be almost exclusively absorbed by or braced on the shoulders of the diver. This is perceived by the diver as unpleasant, especially with increasing diving depth, and it diminishes the comfort and sometimes even the diving performance of the diver.

TASK OF THE INVENTION

It is therefore a task of the present invention to provide an improved diving apparatus that avoids the above-mentioned disadvantages. In particular, it is to be ensured in the diving apparatus according to the invention that the diver is able to free himself easily and quickly from emergency situations in which the air-supply line has become entangled.

PRESENTATION OF THE INVENTION

To accomplish the said task, it is provided according to the invention, in a diving apparatus comprising an air pump having a rigid housing with an interior space, which extends along a longitudinal axis of the housing from an interior-space beginning to an interior-space end and, disposed in a region of the interior-space end, an opening, which is closed by a bag-like flexible part in order to form a variable pump volume, which is bounded by the housing and the flexible part, wherein the air pump is designed in such a way that, in the event of an overpressure caused by surrounding water, the flexible part is pressed into the interior space, with reduction of the pump volume and bears at least in portions on an inner wall of the housing in a contact portion of the interior space, in order to compress air in the pump volume and to supply it from a region of the interior-space beginning via a breathing line to a diver, wherein the contact portion extends along the longitudinal axis from the interior-space end in the direction of the interior-space beginning up to a maximum height, wherein the flexible part can be pulled out of the interior space against the overpressure by muscle power of the diver and with increase of the pump volume, in order to suck in air via an air-supply line from above a water level of the water, wherein furthermore a carrying device for fixation of the air pump in front of the chest of the diver is provided, wherein the air-supply line can be detachably fastened on the carrying device centrally behind the back of the diver, especially on a hip strap of the carrying device, and that, for further fastening of the air-supply line, a quick-release fitting is provided that has a first sliding element, which is fastened on the air-supply line, as is a second sliding element, which is fastened on the carrying device, preferably to the hip strap, wherein the first sliding element and the second sliding element respectively have a mutually complementary geometry, which permits sliding of the two sliding elements into one another, in order to bring the two sliding elements into a condition connected to one another, wherein the two sliding elements in the connected condition are capable of sliding in at least one direction over a certain working range relative to one another, before the two sliding elements can be converted into a detached condition by further sliding in this direction.

Depending on specific geometry of the sliding elements, the sliding into one another may also comprise a sliding over one another.

The fact that the housing is rigid naturally does not exclude a certain elastic deformability—which ultimately is physically unavoidable—of the housing as a function of a force transmission. The rigidity of the housing is to be viewed in particular in relation to the flexibility of the flexible part, wherein the flexible part could also be referred to as a (flexible) diaphragm or pump bellows. Both the housing and the flexible part may be made from respectively suitable plastics.

The opening is an outward opening of the interior space through the housing, although in an operating condition the opening is closed by the flexible part of the diving apparatus. Typically, however, the flexible part may be removed for maintenance and cleaning purposes, wherein the opening is then exposed and the diving apparatus is in a maintenance condition. In the operating condition of the diving apparatus, it is possible to dive in water with it, wherein the diving apparatus and the diver then become surrounded by water (and therefore when the diver is diving with the diving apparatus).

The limitation of the pump volume by the housing and the flexible part is to be understood to the effect that it is not ruled out that still other elements are necessary in order to limit the pump volume completely, for example check valves and/or at least one portion of the air duct.

The region of the interior-space end/interior-space beginning is to be understood as a spatial region, around the interior-space end/interior-space beginning, that comprises the interior-space end/interior-space beginning but is not necessarily restricted to the interior space. Since compressed air is present in any case in the interior space, the compressed air is therefore supplied to the diver, especially from that region of the interior space that lies in the region of the interior-space beginning or in the region around the interior-space beginning. As described, this supply takes place via a breathing line, which accordingly must be in fluidic communication with that region of the interior space that lies in the region of the interior-space beginning and therefore is usually connected to the housing in the region of the interior-space beginning.

In this context, it is clear to the person skilled in the art that a suitable valve arrangement is to be provided that ensures that air sucked in by the air-supply line does not escape from the air-supply line once again when the flexible part is pressed into the interior space. This may be achieved in particular with a first check valve, which could also be referred to as the air-supply valve. Furthermore, it is clear that the valve arrangement must permit inhalation by the diver through the breathing line without allowing the inhaled air to be sucked out of his lungs once again when the flexible part is pulled out of the interior space. This may be achieved in particular by a second check valve. In the cited example, both the first and the second check valves are subjected to and must withstand the full pressure that is built up in the pump volume by the air compression. Finally, it is clear that the valve arrangement must also permit the exhalation by the diver of the inhaled and consumed air into the surrounding water. Accordingly, an exhalation valve for exhalation of the air into the water may be provided in the cited example in addition to the first and second check valves, wherein the exhalation valve is exposed to a relatively lower pressure load than the first and the second check valves.

In view of an optimum function of the air pump or of the diving apparatus, it is advantageous when, if at all possible, no "unused" air-pump volume is present, in which the air is merely compressed and decompressed once again without being supplied to the diver. In order to make such an used air-pump volume as small as possible or even to avoid it completely, the contact portion should extend as far as possible over the interior space, preferably over the entire interior space, and the flexible part should bear on the largest possible portion of the inner wall, preferably substantially on the entire inner wall, in the contact portion, when the flexible part is pressed into the interior space. In the optimum case, the maximum height extends correspondingly up to the interior-space beginning. In principle, however, the function of the diving apparatus remains assured even when the maximum height does not extend to the interior-space beginning, although a somewhat weaker performance of the diving apparatus may be obtained due to the unused pump volume that then exists.

In order that the diver is able to pull the flexible part out of the interior space once again, an actuating device known in itself may be provided. The latter may in particular comprise leg straps having foot loops as well as attaching means, in order to connect the leg straps to the flexible part. In this case, the diver is able to use his legs to pull the flexible part out of the interior space. However, variants of the actuating device are also known, where grip elements for the hands of the diver are provided alternatively or additionally, so that the diver is able to pull the flexible part at least partly out of the interior space even with his arms.

The region of the maximum height is to be understood as a spatial region around the maximum height, that comprises the maximum height but is not necessarily restricted to the interior space.

The fixation of the air pump, especially of the housing, in front of the chest of the diver is desirable, in order to ensure a slightly higher pressure of the surrounding water in the region of the air pump compared with the pressure of the surrounding water in the region of the lungs of the diver, when the diver finds himself in a typical diving position, i.e. in an approximately horizontal or slightly upright position with the abdomen facing down. Accordingly, the air is then compressed by the air pump to a slightly elevated pressure, which typically corresponds to 5 cm to 15 cm water column, thus permitting problem-free inhalation by the diver.

Because the air-supply line is fastened on the carrying device centrally behind the back of the diver, the diver is always able to be optimally balanced, even when pulling forces act on the air-supply line. In particular, the air-supply line is not able to rotate the diver and/or pull him sideways, because pulling forces that affect the diver via the air-supply line act close to the center of gravity of the diver, approximately opposite the navel of the diver.

In emergency situations, in which the air-supply line has become entangled or ensnared on an obstruction, it may be that the diver must detach himself from the air-supply line. On the one hand, a connection of the air-supply line to a port, which in particular may be disposed on the housing, may be necessary for this purpose. On the other hand, the fastening must be detached behind the back of the diver. According to the invention, the quick-release fixture is provided for this purpose, in view of the relatively difficult reachability.

Because of the quick-release fitting, a certain shifting of the two sliding elements is permitted without resulting in a separation of the sliding elements. This is necessary in order, during the normal diving process, to permit a certain unavoidable movement between the carrying device and the air-supply line fastened on it. Moreover, a certain elasticity or deformability of the air-supply line and also of the body of the diver contributes to this unavoidable movement. In the described emergency situation, however, a substantially larger shift takes place when the diver together with the carrying device moves away from the air-supply line entangled on an obstruction, so that the quick-release fitting releases the connection between air-supply line and carrying device.

Since the direction of movement of the diver in this situation always points clearly away from the air-supply line, release is sufficient in principle when the shift exceeds a certain magnitude in precisely one particular direction. Consequently, the quick-release fitting can be manufactured very simply and cost-effectively. Accordingly, it is therefore provided in a particularly preferred embodiment of the diving apparatus according to the invention that the first sliding element is formed as a hook and the second sliding element as an eye or vice versa. Naturally, however, even other embodiments would still be conceivable, for example having a rail and a matching profile member, wherein the rail has a stop, which limits the shifting of the profile member and of the rail relative to one another in one direction.

Beyond this, it is to be asserted quite generally that the profile member obviously may also have the form of a hook, at least in portions.

In this case, however, where a release takes place only during a sufficiently large shift in precisely one particular direction, a correct arrangement of the two sliding elements relative to one another must be achieved for assurance of safety, when the air-supply line is fastened on the carrying device. For enhancement of the safety as well as the comfort of the diver during putting-on of the diving apparatus, it is provided in a particularly preferred embodiment of the diving apparatus according to the invention that the two sliding elements in the connected condition are capable of sliding in two opposite directions relative to one another over the working range before the two sliding elements can be converted to the detached condition by further sliding in these directions.

In order to ensure a design that is particularly simple in relation to manufacturing, especially in this case, it is provided in a particularly preferred embodiment of the diving apparatus according to the invention that the first sliding element is formed as a rail and the second sliding element as a profile member or vice versa.

Furthermore, alternative embodiments are conceivable in which a sufficiently large shift in one or more further directions that is/are not parallel to the two opposite directions additionally brings about a conversion to the detached condition.

In a preferred embodiment of the diving apparatus according to the invention, it is provided that an air duct is provided, which is designed in such a way that, during the suction, the air is able to flow from the region of the interior-space end in the direction of the interior-space beginning at least into a region of maximum height, preferably into the region of the interior-space beginning, and into the interior space. Thus, if the region of the maximum height is not situated in the interior space, the air is sucked from this region into the interior space, so that, as specified, the air is able to flow into the interior space. In other words, the air flows in any case into the region of the maximum height and, to the extent that the air is then not yet in the interior space, it flows from the region of the maximum height into the interior space. To the extent that the region of the maximum height also lies in the interior space, the feature according to which the air is able to flow into the interior space is automatically fulfilled.

In particular, the air duct permits the optimum positioning of a port of the air-supply line, in order to create a fluidic communication of the air-supply line with the air duct and thus also with the interior space, without permitting the action of pulling force on the air-supply line to cause a rotation of the diver from a substantially horizontal to an upright position. Accordingly, it is provided in a preferred embodiment of the diving apparatus according to the invention that a port for the air duct is provided in the region of the interior-space end. This port does not necessarily have to be connected directly to the air duct or disposed on it, but it may also be disposed on the housing. The latter may be the case in particular when the air duct is disposed inside the cross section of the housing or inside the interior space.

Beyond this, an ergonomically particularly favorable access to the port is achieved, which is easily possible for the diver even with the diving apparatus buckled on. Especially in emergency situations, this facilitates the separation of the air-supply line from the port.

In order to permit a particularly rapid detachment of the air-supply line, especially from the housing, in emergency situations, it is provided—completely independently of the presence of an air duct—in a particularly preferred embodiment of the diving apparatus according to the invention that the port for the air-supply line is equipped with a quick-lock fitting for connection to the air-supply line, wherein the quick-lock fitting has in particular a bayonet fitting and/or a short-flight thread and/or a sliding-sleeve fitting. Quick-lock fittings are connections known in themselves. For example, a sliding-sleeve fitting is well known as a garden-hose fitting, and it is capable of permitting a separation of the air-supply line from the port by a simple pulling or pushing of the sliding sleeve. In general, however, a multiplicity of known quick-lock fittings may be considered, e.g. even a snap lock that can be released via a pushbutton to be actuated or a lever to be actuated.

In principle, the most diverse alternative embodiments that comprise the said air duct are conceivable. For example, the air duct could be disposed outside the housing, as an element separate from the housing. However, since such an air duct forms an element that inevitably protrudes from the housing, it is at least not conducive to the ease of handling of the diving apparatus. In addition, the danger is increased that an obstruction will become entangled with the diving apparatus, namely at the air duct, during diving. In order to ensure that the ease of handling of the diving apparatus is not impaired by the air duct, it is provided in a preferred embodiment of the diving apparatus according to the invention that the housing has a cross section normal to the longitudinal axis and the air duct is disposed inside the cross section.

In a particularly preferred embodiment of the diving apparatus according to the invention, it is provided that the air duct is disposed inside the interior space. In this case, the air duct may be realized particularly simply by means of an additional element that in principle is separate from the housing and is disposed in the interior space, which sometimes greatly simplifies the manufacture in the technical respect.

By analogy, it is provided in a preferred embodiment of the diving apparatus according to the invention that the air duct is constructed at least in portions, preferably completely, by a duct-bounding wall separate from the housing. This duct-bounding wall is able to take over the role of the above-mentioned separate element. When the flexible part is then pressed into the interior space (i.e. in the case of arrangement of the air duct in the interior space), it necessarily makes contact in portions with the duct-bounding wall. The duct-bounding wall may then be regarded in some way as a spacer between a portion of the inner wall of the housing and the flexible part, in order to permit the unhindered air flow from the region of the interior-space end to the region of the interior-space beginning.

Furthermore, it may be provided that the duct-bounding wall is fastened detachably to the housing, preferably in the interior space. This permits a removal of the duct-bounding wall for maintenance and cleaning purposes in the maintenance condition of the diving apparatus.

In order to achieve particularly high mechanical robustness, it is provided in a preferred embodiment of the diving apparatus according to the invention that the air duct is formed at least in portions, preferably completely, by the housing. In particular, a housing wall may then be geometrically configured accordingly in such a way that the air duct is disposed inside the cross section of the housing wall. This may even have benefits in relation to manufacturing, in that the housing plus air duct may be produced in one manufacturing step, for example by means of an injection-molding technique.

In a preferred embodiment of the diving apparatus according to the invention, it is provided that several openings viewed in a direction parallel to the longitudinal axis are provided in a manner disposed one after the other and allow the air duct to communicate fluidically with the interior space, when the flexible part is pulled out of the interior space. The air duct could then also be formed substantially by a grid, wherein the openings are made so large or small that the flexible part can be sucked or forced inward through the opening not at all or only negligibly slightly.

The said construction, especially as a grid, may have hygienic benefits during washing out. In addition, the diving apparatus is relatively lightweight due to the material conservation represented by the openings, and thus it permits more comfortable transportation of the diving apparatus according to the invention. Furthermore, the material conservation may lead to some savings in the manufacturing costs.

The provision of the air duct opens up a multiplicity of options for the positioning of the air-supply valve or of the first check valve, going beyond the position in the region of the port of the air-supply line. Beyond this, it is even theoretically possible for the said valve to be disposed at any arbitrary place in the entire extent of the air-supply line. In a preferred embodiment of the diving apparatus according to the invention, it is provided that a first check valve is provided for the air-supply line, wherein the first check valve is interconnected between at least one portion of the air duct and the interior space. "Interconnected" is intended to emphasize the functional arrangement, which does not necessarily have to be identical to the spatial arrangement.

Preferably, the first check valve is attached directly to the air duct.

However, the first check valve could also be disposed in the middle of the air duct, where a particularly good protection of the first check valve against external influences is assured. A positioning of the first check valve in the air duct in the region of the interior-space beginning is particularly advantageous, since in this way the unused air-pump volume can be minimized.

In this regard it is to be pointed out that, in alternative embodiments in which the air duct is constructed with openings or as a grid, an arrangement of the first check valve in the air duct is usually not practical, since the first check valve is then unable to fulfill its blocking function optimally during air compression. In this case, an arrangement of the first check valve in the port of the air-supply line is above all the preferred embodiment.

During diving with the diving apparatus according to the invention, an increasing pulling force must be exerted with increasing depth—due to the increasing overpressure of the surrounding water—in order to pull the flexible part out of the interior space. At a depth of 5 m, for example, this force may be approximately 450 N. As explained above, this force is typically applied by the legs.

Via the carrying device, especially via shoulder straps of the carrying device, the pulling forces are transferred substantially to the shoulders of the diver and from there into the upper region of the back or of the chest/abdomen of the diver, which during greater load, i.e. at greater depth, is sensed as unpleasant and may detract from the comfort and the diving performance.

In order to improve the comfort and the diving performance of the diver, it is provided in a preferred embodiment of the diving apparatus according to the invention that at least one stiffening element is provided, in order to transfer pulling forces that act on the housing during pulling of the flexible part out of the interior space into a region of the pelvis of the diver, especially on the front side, wherein the stiffening element is connected to the housing and in an operating condition of the diving apparatus protrudes from the housing in the region of the interior-space end.

Via the stiffening element fastened on the housing, the pulling forces occurring at the housing are therefore transmitted at least partly—as compressive forces—into the region of the hips or of the pelvis of the diver, wherein the region is usually disposed on the front side of the body of the diver, since the air pump, especially the housing, is usually fixed, as explained above, in front of the chest of the diver.

For anatomical reasons, namely due to the position of the lungs in the body of the diver, the said housing must be placed relatively high on the upper body, in order to be disposed as tightly as possible on the lungs and, in case of a change of position of the diver, correspondingly to ensure a slight overpressure, as constant as possible, of the air pressure generated with the air pump on the basis of the surrounding overpressure compared with the surrounding overpressure at the position of the lungs of the diver. In this way it is ensured that the pressure of the air supplied to the lungs of the diver is adapted optimally (i.e. is slightly higher) to the overpressure (in the region of the lungs of the diver) caused by the surrounding water. However, this arrangement has as a consequence a certain distance from the housing to the pelvic/hip region of the diver, which distance is bridged by the at least one stiffening element. Accordingly, the stiffening element is so disposed that, at least in the operating condition, it points away both from the interior-space end and from the interior-space beginning and extends at least in portions along the longitudinal axis of the housing.

The stiffening element is therefore able to absorb the pulling forces acting on the housing as compressive forces and to transmit them at least partly into mechanically robust regions of the body of the diver or to brace them on these regions, wherein the region of the pubic bone is to be mentioned in particular here.

The said stiffening element may preferably consist of a substantially rigid plastic, in order that it can transfer the pulling forces particularly efficiently. However, in order to increase the comfort of the diver in this case, the stiffening element may even be provided with cushioning elements (e.g. of neoprene), especially at portions that are supported on the body of the diver and press particularly strongly on the body of the diver during transfer of the pulling forces.

It must be emphasized that the stiffening element may be provided independently of the quick-release fitting and/or the air duct. Accordingly, it is provided according to the invention, in a diving apparatus comprising an air pump having a rigid housing with an interior space, which extends along a longitudinal axis of the housing from an interior-space beginning to an interior-space end and, disposed in a region of the interior-space end, an opening, which is closed by a bag-like flexible part in order to form a variable pump volume, which is bounded by the housing and the flexible part, wherein the air pump is designed in such a way that, in the event of an overpressure caused by surrounding water, the flexible part is pressed into the interior space, with reduction of the pump volume and bears at least in portions on an inner wall of the housing in a contact portion of the interior space, in order to compress air in the pump volume and to supply it from a region of the interior-space beginning via a breathing line to a diver, wherein the contact portion extends along the longitudinal axis from the interior-space end in the direction of the interior-space beginning up to a maximum height, wherein the flexible part can be pulled out of the interior space against the overpressure by muscle power of the diver and with increase of the pump volume, in order to suck in air via an air-supply line from above a water level of the water, wherein furthermore a carrying device for fixation of the air pump in front of the chest of the diver is provided, that at least one stiffening element is provided, in order to be able to transfer pulling forces that act on the housing during pulling of the flexible part out of the interior space into a region of the pelvis of the diver, especially on the front side, wherein the stiffening element is connected to the housing and in an operating condition of the diving apparatus protrudes from the housing in the region of the interior-space end.

In order to be able to deflect the occurring pulling forces even better into the pelvic/hip region of the diver, a hip strap of the carrying device is provided, which preferably is configured to be particularly broad or high. In order to permit an optimum interaction of the hip strap with the at least one stiffening element and thus an optimum deflection of the occurring pulling forces into the pelvic/hip region of the diver, it is provided in a particularly preferred embodiment of the diving apparatus according to the invention that the at least one stiffening element can be connected to a hip strap of a carrying device.

In principle, the at least one stiffening element may have the most diverse shapes, provided that the stiffening element is merely stiff enough to be able to absorb and transfer the occurring compressive forces. For example, the at least one stiffening element may be formed as struts and/or yokes. In a particularly preferred embodiment of the diving apparatus according to the invention, it is provided that the at least one stiffening element is constructed substantially in the form of a plate. Besides the assurance of the necessary stiffness, this also permits a supporting of the stiffening element on the body that is pleasant for the diver.

As already described, the at least one stiffening element represents a bridging of the distance between the housing and the pelvic/hip region of the diver, when the diver is using the diving apparatus according to the invention. Accordingly, a length of the stiffening element is achieved that is comparable with a length of the housing, wherein the lengths in the operating condition are respectively measured along the longitudinal axis of the housing and typically lie in the range of 20 cm to 40 cm. In order to permit, on the one hand, a better adaptation of the stiffening element to the body of the diver and, on the other hand, a space-saving transportation of the diving apparatus according to the invention, it is provided in a particularly preferred embodiment of the diving apparatus according to the invention that the at least one stiffening element is fastened pivotally on the housing. During transportation, the at least one stiffening element may preferably be pivoted such that it bears on the housing and does not protrude from it, in order to ensure a minimum length of the diving apparatus according to the invention. The diving apparatus according to the invention is then in a transportation condition.

A corresponding pivoting axis of the stiffening element is disposed substantially normal to the longitudinal axis of the housing. In particular, the said pivoting axis may be parallel to a direction in which a width of the housing is measured. Accordingly, in a plate-shaped construction of the stiffening element, the pivoting axis then preferably lies in a plane of the plate of the stiffening element.

However, an arrangement of the pivoting axis would also be conceivable that is normal to the longitudinal axis of the housing and normal to the direction in which the width of the housing is measured. Accordingly, in a plate-shaped construction of the stiffening element, the pivoting axis is then preferably disposed normal to the plane of the plate of the stiffening element. Particularly preferably, the pivoting axis disposed in this way intersects the longitudinal axis of the housing.

It should be noted that it would also be conceivable to fasten at least one stiffening element detachably on the housing, wherein, in the transportation condition, the stiffening element is detached from the housing. Compared with the alternative embodiment having the pivotability of the stiffening element, however, the latter has the disadvantage that the stiffening element can be lost more easily during transportation.

BRIEF DESCRIPTION OF THE FIGURES

The invention will now be explained in more detail on the basis of exemplary embodiments. The drawings are exemplary and, although they are certainly intended to explain it, they are in no case intended to restrict it or even describe it conclusively.

Therein:

FIG. 3 shows a schematic cross-sectional view of the housing according to the section line A-A from FIG. 2, wherein the arrows indicate the viewing direction FIG. 4 shows a view analogous to FIG. 3 of a further embodiment of the diving apparatus according to the invention FIG. 5 shows a view analogous to FIG. 3 of a further embodiment of the diving apparatus according to the invention FIG. 6 shows a view analogous to FIG. 3 of a further embodiment of the diving apparatus according to the invention FIG. 7 shows a view analogous to FIG. 3 of a further embodiment of the diving apparatus according to the invention FIG. 8*a* to FIG. 8*d* show different embodiments of a quick-release fitting of the diving apparatus according to the invention, wherein a first and a second sliding element are present in a connected condition FIGS. 9*a* and 9*b* show a detail view of different embodiments of a quick-release fitting of the diving apparatus according to the invention, wherein the first and the second sliding element are present in a detached condition

WAYS OF WORKING THE INVENTION

Figure 1:
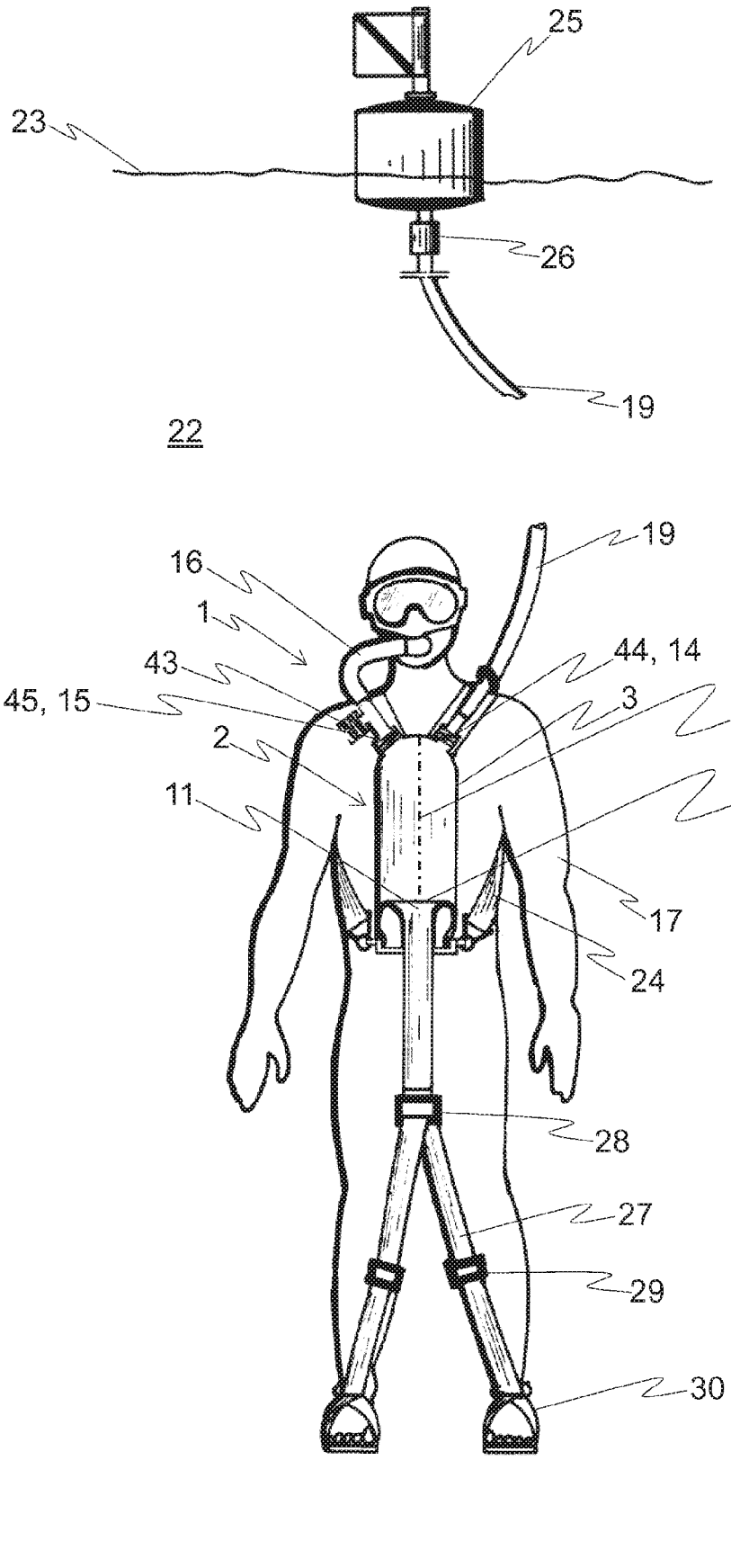
FIG. 1 shows a diving apparatus according to the prior art

FIG. 1 shows a diving apparatus 1 according to the prior art, as is disclosed in EP 0297416 B1. In order to be able to suck in air from the atmosphere above a water level 23 during diving in water 22 and compress it to the pressure matching the respective depth under water 22, the diving apparatus 1 comprises an air pump 2, which is provided with a rigid housing 3 having an interior space 4 (see FIG. 2) as well as a bag-like flexible part 11. In an operating condition of the diving apparatus 1, in which it is possible to be submerged together with the diving apparatus 1, the bag-like flexible part 11 closes an opening 8 of the interior space 4. The interior space 4 extends along a longitudinal axis 5 of the housing 3 from an interior-space beginning 6 to an interior-space end 7, wherein the opening 8 is disposed in a region 10 of the interior-space end 7 or around the interior-space end 7.

The housing 3 and the flexible part 11 therefore bound a variable pump volume, wherein the air pump 2 is designed in such a way that, at an overpressure caused by the surrounding water 22, the flexible part 11 is pressed into the interior space 4 with decrease of the pump volume and bears at least in portions on an inner wall 13 of the housing 3 in a contact portion 12 of the interior space 4, in order to compress air in the pump volume and to supply it to a diver 17 from a region 9 of the interior-space beginning 6 via a breathing line 16. The said contact portion 12 of the interior space 4 extends along the longitudinal axis 5 from the interior-space end 7 in the direction of the interior-space 6 up to a maximum height 18.

By means of a carrying device, which in the known exemplary embodiment of FIG. 1 consists substantially of two shoulder straps 24, the air-pump 7, especially the housing 3, is fixed in front of the chest of the diver 17. For anatomical reasons, namely due to the position of the lungs in the body of the diver 17, the said housing 3 must be placed relatively high on the upper body, in order to be disposed as tightly as possible on the lungs and, in case of a change of position of the diver 17, correspondingly to ensure a slight overpressure, as constant as possible, of the air pressure generated with the air pump 2 on the basis of the surrounding overpressure compared with the surrounding overpressure at the position of the lungs of the diver 17. In this way it is ensured that the pressure of the air supplied to the lungs of the diver 17 is adapted optimally to the overpressure (in the region of the lungs of the diver 17) caused by the surrounding water 22, to the effect that namely the pressure of the air supplied to the lungs of the diver 17 is slightly higher than the overpressure caused by the surrounding water 22 in the region of the lungs of the diver 17.

For sucking in of the air from above the water level 23, an air-supply line 19 is provided, which may be constructed, for example as a pressure hose known in itself. According to FIG. 1, the air-supply line 19 is fastened during diving to a buoy 25 by means of a hose connection 26, wherein the air above the buoy 25 is able to flow into the air-supply line 19. When the diver 17 is swimming under water 22, the buoy 25 is pulled along via the air-supply line 19. In order now to suck in air via the air-supply line 19, the flexible part 11 is pulled out of the interior space 4 against the overpressure of the surrounding water 22, accompanied by increase of the pump volume, wherein this is achieved by muscle power of the diver 17.

For this purpose, an actuating device is provided, which according to the prior art may comprise leg straps 27 having foot loops 30 (for accommodation of the feet of the diver 17) as well as attaching means in the form of a connecting clasp 28, in order to connect the leg straps 27 to the flexible part 11. In this case, the diver 17 is able to use his legs to pull the flexible part 11 out of the interior space 4. For adaptation to the height or leg length of the diver 17, the leg straps 27 are respectively provided with a length-adjusting means 29 known in itself; see FIG. 1.

A suitable valve arrangement ensures that air sucked in by the air-supply line 19 does not escape from the air-supply line 19 once again when the flexible part 11 is pressed into the interior space 4. This may be achieved in particular with a first check valve 14, which could also be referred to as an air-supply valve; see FIG. 1. Furthermore, the valve arrangement permits inhalation by the diver 17 through the breathing line 16 without allowing the inhaled air to be sucked out of his lungs once again when the flexible part 11 is pulled out of the interior space 4. This may be accomplished in particular by a second check valve 15; see FIG. 1. In the example illustrated in FIG. 1, both the first check valve 14 and the second check valve 15 are subjected to and must withstand the full pressure that is built up in the pump volume by the air compression. In particular, in dependence on the arrangement of the second check valve 15, the breathing line 16 may also be constructed as a pressure hose known in itself, preferably when the second check valve 15 is disposed in the region of the mouth of the diver 17 (not illustrated). Finally, the valve arrangement also permits the exhalation by the diver 17 of the inhaled and consumed air into the surrounding water 22. For this purpose, an exhalation valve 43 for exhalation of the air into the water 22 is provided in the exemplary embodiment of FIG. 1 in addition to the first check valve 14 and second check valve 15, wherein the exhalation valve 43 is exposed to a relatively lower pressure load than the first check valve 14 and the second check valve 15. Suitable 14, 15, 43 are known in themselves.

Since the contact portion 12 extends up to the maximum height 18, fluidic communications must be established between the air-supply line 19 as well as the breathing line 16 on the one hand and the interior space 4 in a region from the region 21 of the maximum height 18 up to the region 9 of the interior-space beginning 6 on the other hand. Otherwise the fluidic communications between the air-supply line 19/the breathing line 16 and the interior space 4 would be interrupted when the flexible part 11 bears on the inner wall 13 in the contact portion 12. When the maximum height 18 extends into the region 9 of the interior-space beginning 6, then fluidic communications must be provided correspondingly in the interior-space 4 in the region 9 of the interior-space beginning 6. According to the prior art, a port 45 for the breathing line 16 and a port 44 for the air-supply line 19 are therefore provided on the housing in the region 9 of the interior-space beginning 6; see FIG. 1. In this case, the first check valve 14 is disposed in the port 44 of the air-supply line 19 and the second check valve 15 in the port 45 of the breathing line 16.

In the diving apparatus 1 according to the invention, it is provided that the air-supply line 19 can be detachably fastened centrally behind the back of the diver 17, especially on a hip strap 40 (see, for example, FIGS. 8*a*-8*d*) of the carrying device. Because the air-supply line 19 is fastened on the carrying device centrally behind the back of the diver 17, the diver 17 is always able to be optimally balanced, even when pulling forces act on the air-supply line 19. In particular, the air-supply line 19 is not able to rotate the diver 17 and/or pull him sideways, because pulling forces that affect the diver 17 via the air-supply line 19 act close to the center of gravity of the diver 17, approximately opposite the navel of the diver 17. Beyond this, an ergonomically particularly favorable access to the port 44 is achieved, which is easily reachable for the diver 17 even with the diving apparatus 1 buckled on, for example in order, in emergency situations, to be able to undertake a rapid separation of the air-supply line 19 from the port 44.

In emergency situations, in which the air-supply line 19 is entangled on an obstruction, it may be necessary for the diver 17 to separate himself from the air-supply line 19, in order to be able to surface. In order to permit a simple and rapid separation of the air-supply line 19 from the port 44, a quick-lock fitting (not illustrated) known in itself may be provided for port 44.

In order now to also ensure a problem-free separation of the air-supply line 19 from the carrying device centrally behind the back of the diver 17, an automatic separation by means of a quick-release fitting 32 used for the detachable fastening is provided in preferred embodiments of the diving apparatus 1 according to the invention; see FIGS. 8*a*-*d* as well as FIGS. 9*a*-*b*. For this purpose, it is provided that the quick-release fitting 32 has a first sliding element, which is fastened on the air-supply line 19, and a second sliding element, which is fastened on the carrying device, preferably on the hip strap 40, wherein the first sliding element and the second sliding element respectively have a mutually complementary geometry, which permits sliding of the two sliding elements into one another, in order to bring the two sliding elements into a condition 37 connected to one another (see FIGS. 8*a*-*d*), wherein the two sliding elements in the connected condition 37 are capable of sliding relative to one another in at least one direction over a certain working range 39, before the two sliding elements can be converted into a detached condition 38 by further sliding in this direction (see FIGS. 9*a*-*b*).

Because of the quick-release fitting 32, therefore, a certain shifting of the two sliding elements is permitted without resulting in separation of the sliding elements. This is necessary in order, during the normal diving process, to permit a certain unavoidable movement between the carrying device and the air-supply line 19 fastened on it. In the described emergency situation, however, a substantially larger shift takes place when the diver 17 together with the carrying device moves away from the air-supply line 19 ensnared on an obstruction, so that the quick-release fitting 32 releases the connection between air-supply line 19 and carrying device.

Since the direction of movement of the diver 17 in this situation always points clearly away from the air-supply line 19, release is sufficient in principle when the shift exceeds a certain magnitude in precisely one particular direction. Consequently, the quick-release fitting 32 can be manufactured very simply and cost-effectively. Accordingly, it is therefore provided in a particularly preferred embodiment of the diving apparatus 1 according to the invention that the first sliding element is formed as a hook 33 and the second sliding element as an eye 34 or vice versa. FIG. 8*a* shows a variant in which the first sliding element, which is connected to the air-supply line 19, is constructed as the hook 33, and the second sliding element, which is connected to the hip strap 40, as the eye 34. The working range 39 substantially is defined by a hook length between a free end of the hook 33 and a closed end of the hook 33, wherein the release takes place only in one direction. The latter would be the case when the diver 17 or the hip strap 40 in FIG. 8*a* were to move so far to the right that the eye 34 would slip off from the free end of the hook 33. In contrast, during a movement of the hip strap 40 to the left, no conversion to the detached condition 38 would take place, since the eye 34 would be stopped at the closed end of the hook 33.

FIG. 8*b* shows the inverse situation, where the hook 33 is fixed on the hip strap 40 and the eye 34 on the air-supply line 19, wherein the description of FIG. 8*a* is applicable by analogy.

It should be noted that, for adaptation to the body circumference of the diver 17, the hook 33 (FIG. 8*a*) or the eye (FIG. 8*b*) may be shifted correspondingly along the air line 19, before the hook 33 (FIG. 8*a*) or the eye 34 (FIG. 8*b*) is fixed on the air line 19.

In the alternative embodiments of FIG. 8*a* and FIG. 8*b*, where a release takes place only during a sufficiently large shift in precisely one particular direction, a correct arrangement of the two sliding elements relative to one another, i.e. of the respective hook 33 relative to the respective eye 34, must be achieved for assurance of safety, when the air-supply line 19 is fastened on the carrying device or on the hip strap 40.

For enhancement of the safety as well as of the comfort of the diver 17 during putting-on of the diving apparatus 1, it is provided in a particularly preferred embodiment of the diving apparatus 1 according to the invention that the two sliding elements in the connected condition 37 are capable of sliding relative to one another in two opposite directions over the working range 39 before the two sliding elements can be converted to the detached condition 38 by further sliding in these directions. For example, the first sliding element may be constructed as a rail 35 and the second sliding element as a profile member 36 or vice versa, wherein the profile member 36 may be pushed onto the rail 35 at both of its ends.

FIG. 8*c* indeed shows a case in which the first sliding element is constructed as the profile member 36 and the second sliding element as the rail 35, but the rail 35 is provided at one end with a stop 50, so that once again a situation analogous to the exemplary embodiments of FIGS. 8*a* and 8*b* is obtained. Because its geometry is complementary to the rail geometry, the profile member 36 can be pushed onto the rail 35, in order to establish the connected condition 37, albeit only at that—free—end of the rail 35 that is not equipped with the stop 50. In the connected condition 37, the profile member 36 can then be moved along the entire extent of the rail 35 without canceling the connected condition 37. In other words, the extent of the rail 35 defines the working range 39. Thus a detachment of the profile member 36 from the rail 35 is possible here only by sufficiently large shifting in one direction. The latter leads to a detachment of the connected condition 37 and establishes the detached condition 38. Thus, if the hip strap 40 in FIG. 8*c* were to be shifted sufficiently to the right, this would lead to conversion into the detached condition 38. FIG. 8*b* shows the inverse situation, where the profile member 36 is fixed on the hip strap 40 and the rail 35 together with stop 50 on the air-supply line 19, wherein the description of FIG. 8*c* is applicable by analogy.

It should be noted that, for adaptation to the body circumference of the diver 17, the profile member 36 (FIG. 8*c*) or the rail 35 (FIG. 8*d*) may be shifted correspondingly along the air line 19, before the profile member 36 (FIG. 8*c*) or the rail 35 (FIG. 8*d*) is fixed on the air line 19.

FIG. 9*a* shows, by way of example, a rail 35 and a profile member 36 in the detached condition 38. The rail 35 has a negative profile in the form of a recess having substantially U-shaped cross section where the ends of the limbs of the U-shape point toward one another and the profile member 36 having a positive profile with a substantially T-shaped cross section can be pushed in laterally, in order to establish the connected condition 37. Thus, in the connected condition 37, the profile member 36 is in engagement with the rail 35. By virtue of the complementary geometries of the rail 35 and of the profile member 36, the profile member 36 in the connected condition 37 can be pushed only along the extent of the rail 35, but not approximately perpendicular to the extent of the rail 35. The rail 35 here has two free ends—without stop 50—so that a conversion from the connected condition 37 to the detached condition 38 is possible by sufficiently large shifting of the profile member 36 along the rail 35 in two opposite directions.

FIG. 9*b* shows a completely analogous embodiment, in which, however, the rail 35 has a positive profile with substantially T-shaped cross section and the profile member 36 a negative profile having substantially U-shaped cross section where the ends of the U-shape point toward one another. Accordingly, the profile member 36 can be pushed laterally—at both free ends—onto the rail 35, in order to establish the connected condition 37. In turn, by virtue of the complementary geometries of the rail 35 and of the profile member 36, the profile member 36 in the connected condition 37 can be pushed only along the extent of the rail 35, but not approximately perpendicular to the extent of the rail 35. A conversion from the connected condition 37 to the detached condition 38 is possible by sufficiently large shifting of the profile member 36 along the rail 35 in two opposite directions.

The arrangement of the port 44 of the air-supply line 19, known from the prior art and illustrated in FIG. 1, is not optimum with respect to a rapid separation of the air-supply line 19 from the port 44 in emergency situations, since the port 44 is sometimes not easily accessible for the diver 17. Furthermore, this arrangement of the port 44 may sometimes cause, during forward swimming under water 22, pulling forces to be introduced via the air-supply line 19, which forces tend to turn the diver 17 from an optimum horizontal position into an upright position.

Figure 2:
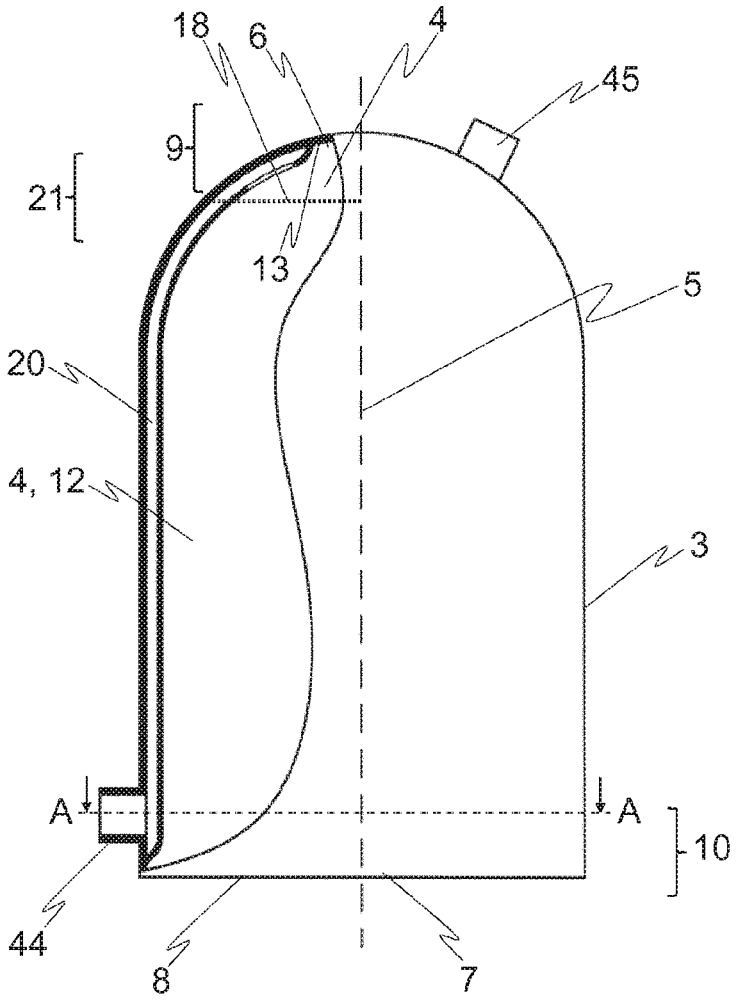
FIG. 2 shows a schematic, partly cutaway front view of a housing of an air pump of one embodiment of a diving apparatus according to the invention

FIG. 2 shows a schematic, partly cutaway front view of a housing 3 of an air pump 2 of one embodiment of a diving apparatus 1 according to the invention, in which this problem does not occur, because the port 44 of the air-supply line 19 is disposed on the housing 3 in the region 10 of the interior-space end 7. Accordingly, the air sucked in by the port 44 through the air-supply line 19, i.e. from the region 10 of the interior-space end 7, is able to flow at least into that region of the interior space 4 which lies in the region 21 of the maximum height 18, preferably in the region 9 of the interior-space beginning 6, in order that it can be compressed there. This is made possible by an air duct 20, which ensures the fluidic communication of the air-supply line 19 or of the port 44 in the region 21 of the maximum height 18 or in the region 9 of the interior-space 6 in the interior space 4, without allowing the fluidic communication to be interrupted by the flexible part 11 forced into the interior space 4. In other words, the air duct 20 is designed in such a way that, during suction, the air is able to flow from the region 10 of the interior-space end 7 in the direction of the interior-space beginning 6, at least into a region 21 of the maximum height 18, preferably into the region 9 of the interior-space beginning 6, and into the interior space 4.

The most diverse alternative embodiments are now possible for such an air duct 20. In order to ensure that the ease of handling of the diving apparatus 1 is not impaired by the air duct 20, it may be provided that the housing 3 has a cross section normal to the longitudinal axis 5 and the air duct 20 is disposed inside the cross section. FIGS. 3, 4, 5 and 6 respectively show a schematic cross section of the housing 3 according to the section line A-A (the arrows indicate the viewing direction) from FIG. 2 for different embodiments of the diving apparatus 1 according to the invention, to which this is applicable.

In the alternative embodiment of FIG. 3, the air duct 20 is formed completely by a duct-bounding wall 31, which is separate from the housing 3 and, moreover, even forms the port 44 as well.

In the alternative embodiments of FIG. 5 and of FIG. 6, the air duct 20 is formed only partly by the duct-bounding wall 31, namely by the housing 3 on the one hand and by the duct-bounding wall 31 on the other hand. In this case, the housing 3 or a housing wall also forms the port 44. The duct-bounding wall 31 forms a portion of the air duct 20 disposed opposite the port 44.

In FIG. 5, the said duct-bounding wall 31—and thus at least the air duct 20 in portions—is disposed inside the interior space 4, as also in FIG. 3. In FIG. 6, in contrast, the duct-bounding wall 31 forms a continuation of the housing wall and thus bounds the interior space 4, i.e. the air duct 20 is disposed at least in portions outside the interior space 20 here.

FIG. 4 shows an alternative embodiment, in which the air duct 20 is formed completely by the housing 3 or the housing wall. The same is the case for the port 44. Accordingly, the air duct 20 is indeed disposed inside the said cross section of the housing 3 but outside the interior space 4.

In the alternative embodiment having duct-bounding wall 31, shown in FIGS. 3, 5 and 6, the flexible part 11 comes into contact not only on inner wall 13 but also on duct-bounding wall 31, when the flexible part 11 is forced into the interior space 4.

In the alternative embodiment of FIG. 7, the air duct 20 as well as the port 44 is indeed likewise formed by the duct-bounding wall 31, but the latter as well as the air duct 20 is disposed at least in portions outside the housing 3, which may be advantageous in relation to manufacturing.

It should be noted that the first check valve 14 does not always necessarily have to be positioned in the port 44. In principle, the first check valve 14 may also be disposed in the air-supply line 19 or, if the air duct 20 is constructed to be inherently airtight, in the air duct 20 or between the air duct 20 and the interior space 4, especially in the interior space 4 in the region 21 of the maximum height 18 or in the region 9 of the interior-space beginning 6 (not illustrated).

Figure 10:
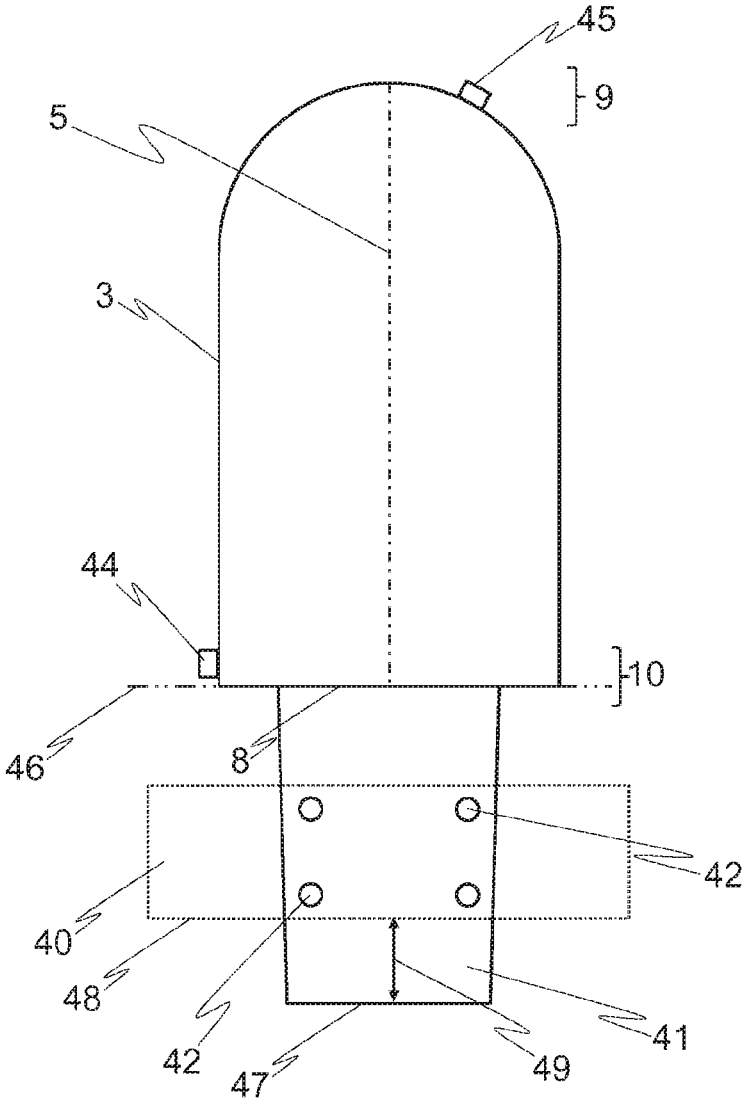
FIG. 10 shows a schematic front view of a housing of a further embodiment of the diving apparatus according to the invention, together with a stiffening element

FIG. 10 shows a further preferred embodiment of the diving apparatus 1 according to the invention having a stiffening element 41, which is provided, to be able to transfer, as compressive forces, pulling forces that act on the housing 3 during pulling of the flexible part 11 out of the interior space 4 into a region of the pelvis on the front side of the diver 17, wherein the stiffening element 41 is connected to the housing 3 and in the operating condition of the diving apparatus 1 protrudes from the housing 3 in the region 10 of the interior-space end 7.

The stiffening element 41 according to FIG. 10 is constructed in the form of a plate with a trapeziform geometry, which is symmetric relative to the longitudinal axis 5 and tapers slightly in a direction parallel to the longitudinal axis 5 and viewed pointing away from the housing 3. The relatively small degree of the taper means that a width of the stiffening element 41, measured in the plane of the drawing and normal to the longitudinal axis 5, is also sufficiently large at a lower, free end 47 of the stiffening element 41 to transfer compressive forces in a way that is more pleasant for the diver 17 into the region of the hips or of the pelvis, especially into the region of the pubic bone of the diver 17. However, other geometries of the stiffening element 41 that achieve this would also be conceivable, for example a rectangular geometry, which in particular is symmetric relative to the longitudinal axis 5.

For the stiffening element 41, at least one connecting element 42 known in itself is provided, with which the stiffening element 41 can be connected to the hip strap 40, which is indicated by only a dotted line in FIG. 10, in order to permit even better transfer of the compressive forces to the region of the pelvis or hips of the diver 17 by means of the hip strap 40. The at least one connecting element 42 may comprise, for example, at least one clasp or at least one pressure lock or at least one mechanical interlock, etc. In this case, the at least one connecting element 42 may comprise respective corresponding parts on the stiffening element 41 and on the hip strap 40. As the at least one connecting element 42, however, a pouch (not illustrated), for example, may also be fastened on the hip strap 40, into which pouch the stiffening element 41 is introduced, in order to establish the connection to the hip strap 40 and to be able to transfer compressive forces to the hip strap 40.

In order that an optimum force transfer into the region of the pubic bone of the diver 17 can be ensured, a length of the stiffening element 41 measured along the longitudinal axis 5 is to be dimensioned in such a way that the free end 47 projects with a certain overhang 49 beyond a lower edge 48 of the hip strap 40. In the diagram of FIG. 10, the free end 47 is disposed correspondingly under the lower edge 48, with the overhang 49 as the spacing between the free end 47 and the lower edge 48. In this way, a compressive load pointing down in FIG. 10 and transferred by the stiffening element 41 can be converted into a kind of tilting load or tilting movement of the stiffening element 41, so that the stiffening element 41 presses against the body of the diver 17, in the region of his public bone, with a component pointing into the plane of the drawing.

All connecting elements 42 mentioned above permit such a dimensioning and arrangement of the stiffening element 41.

Just as the housing 3, the stiffening element 41 may also be made from a substantially rigid plastic.

In order to permit, on the one hand, a better adaptation of the stiffening element 41 to the body of the diver 17 and, on the other hand, a space-saving transportation of the diving apparatus 1 according to the invention, the stiffening element 41 in the exemplary embodiment of FIG. 10 is fastened pivotally on the housing 3, around a pivoting axis 46.

During transportation, the stiffening element 41 may therefore be pivoted by approximately 180° (upward in FIG. 10) such that it bears on the housing 3 and does not protrude from it, in order to ensure a minimum length of the diving apparatus 1 according to the invention. The diving apparatus 1 according to the invention is then in a transportation condition.

The pivoting axis 46 of the stiffening element 41 is disposed substantially normal to the longitudinal axis 5 of the housing 3. In particular, the pivoting axis 46 may be disposed parallel to a direction in which a width of the housing 3 is measured, wherein such a pivoting axis 46 is shown in FIG. 10 and lies in the plane of the drawing of FIG. 10. In this case, the plane of the drawing in turn coincides with a plane of the plate of the plate-shaped stiffening element 41.

It should be noted, however, that other arrangements of the pivoting axis 46 are also possible, especially an arrangement of the pivoting axis 46 normal to the longitudinal axis 5 and normal to the direction in which the width of the housing 3 is measured. A pivoting axis 46 disposed in such a way would be normal to the plane of the drawing of FIG. 10. Preferably, a pivoting axis 46 disposed in such a way is able to intersect the longitudinal axis 5.

LIST OF REFERENCE SYMBOLS

1 Diving apparatus
2 Air pump
3 Housing
4 Interior space
5 Longitudinal axis of the housing
6 Interior-space beginning
7 Interior-space end
8 Opening of the interior space
9 Region of the interior-space beginning
10 Region of the interior-space end
11 Flexible part
12 Contact portion of the interior space
13 Inner wall
14 First check valve

15 Second check valve
16 Breathing line
17 Diver
18 Maximum height of the contact portion
19 Air-supply line
20 Air duct
21 Region of the maximum height of the contact portion
22 Water
23 Water level
24 Shoulder strap
25 Buoy
26 Hose connection
27 Leg strap
28 Connecting clasp
29 Length adjusting means
30 Foot loop
31 Separate duct-bounding wall
32 Quick-release fitting
33 Hook
34 Eye
35 Rail
36 Profile member
37 Connected condition
38 Detached condition
39 Working range
40 Hip strap
41 Stiffening element
42 Connecting element for the stiffening element
43 Exhalation valve
44 Port for the air-supply line
45 Port for the breathing line
46 Pivoting axis
47 Free end of the stiffening element
48 Lower edge of the hip strap
49 Overhang
50 Stop

The invention claimed is:

1. A diving apparatus (1) comprising an air pump (2) having a rigid housing (3) with an interior space (4), which extends along a longitudinal axis (5) of the housing (3) from an interior-space beginning (6) to an interior-space end (7) and, disposed in a region (10) of the interior-space end (7), an opening (8), which is closed by a bag-shaped flexible part (11) in order to form a variable pump volume, which is bounded by the housing (3) and the flexible part (11), wherein the air pump (2) is designed in such a way that, in the event of an overpressure caused by surrounding water (22), the flexible part (11) is pressed into the interior space (4), with reduction of the pump volume and bears at least in portions on an inner wall (13) of the housing (3) in a contact portion (12) of the interior space (4), in order to compress air in the pump volume and to supply it from a region (9) of the interior-space beginning (6) via a breathing line (16) to a diver (17), wherein the contact portion (12) extends along the longitudinal axis (5) from the interior-space end (7) in the direction of the interior-space beginning (6) up to a maximum height (18), wherein the flexible part (11) is configured to be pulled out of the interior space (4) against the overpressure by muscle power of the diver (17) and with increase of the pump volume, in order to suck in air via an air-supply line (19) from above a water level (23) of the water (22), wherein furthermore a carrying device (24) for fixation of the air pump (2) in front of the chest of the diver (17) is provided, wherein the air-supply line (19) is configured to be detachably fastened centrally behind the back of the diver (17) on the carrying device, and wherein a quick-release fitting (32) is provided for detachable fastening of the air-supply line (19), which has a first sliding element (33, 34; 35, 36), which is fastened on the air-supply line (19), and a second sliding element (34, 33; 36, 35), which is fastened on the carrying device, wherein the first sliding element (33, 34; 35, 36) and the second sliding element (34, 33; 36, 35) respectively have a mutually complementary geometry, which permits sliding of the two sliding elements (33, 34; 35, 36) into one another, in order to bring the two sliding elements (33, 34; 35, 36) into a condition (37) connected to one another, wherein the two sliding elements (33, 34; 35, 36) in the connected condition (37) are capable of sliding in at least one direction relative to one another over a certain working range (39), before the two sliding elements (33, 34; 35, 36) can be converted into a detached condition (38) by further sliding in this direction, wherein at least one stiffening element is provided in order to transfer pulling forces that act on the housing during pulling of the flexible part out of the interior space into a region of the pelvis of the diver, wherein the at least one stiffening element is connected to the housing and in an operating condition of the diving apparatus protrudes from the housing in the region of the interior-space end.

2. The diving apparatus (1) according to claim 1, wherein the two sliding elements (33, 34; 35, 36) in the connected condition (37) are capable of sliding relative to one another in two opposite directions over the working range (39), before the two sliding elements (33, 34; 35, 36) can be converted to the detached condition (38) by further sliding in these directions.

3. The diving apparatus (1) according to claim 1, wherein the first sliding element is constructed as a rail (35) and the second sliding element as a profile member (36) or vice versa.

4. The diving apparatus (1) according to claim 1, wherein the first sliding element is constructed as a hook (33) and the second sliding element as an eye (34) or vice versa.

5. The diving apparatus (1) according to claim 1, wherein an air duct (20) is provided, which is designed in such a way that, during the suction, the air is able to flow from the region (10) of the interior-space end (7) in the direction of the interior-space beginning (6) at least into a region (21) of the maximum height (18) and into the interior space (4).

6. The diving apparatus (1) according to claim 5, wherein the housing (3) has a cross section normal to the longitudinal axis (5) and the air duct (20) is disposed inside the cross section.

7. The diving apparatus (1) according to claim 6, wherein the air duct (20) is disposed inside the interior space (4).

8. The diving apparatus (1) according to claim 5, wherein the air duct (20) is constructed at least in portions by a duct-bounding wall (31) separate from the housing (3).

9. The diving apparatus (1) according to claim 5, wherein the air duct (20) is constructed at least in portions by the housing (3).

10. The diving apparatus (1) according to claim 5, wherein a first check valve (14) is provided for the air-supply line (19), wherein the first check valve (14) is interconnected between at least one portion of the air duct (20) and the interior space (4).

11. The diving apparatus (1) according to claim 1, wherein a port (44) for the air-supply line (19) is provided in the region (10) of the interior-space end (7).

12. The diving apparatus (1) according to claim 11, wherein the port (44) for the air-supply line (19) is equipped with a quick-lock fitting for connection to the air-supply line (19).

13. The diving apparatus according to claim 1, wherein the at least one stiffening element (41) is connected to a hip strap (40) of the carrying device.

14. The diving apparatus according to claim 1, wherein the at least one stiffening element (41) comprises a plate.

15. The diving apparatus according to claim 1, wherein the at least one stiffening element (41) is fastened pivotally on the housing.

16. A diving apparatus (1) comprising an air pump (2) having a rigid housing (3) with an interior space (4), which extends along a longitudinal axis (5) of the housing (3) from an interior-space beginning (6) to an interior-space end (7) and, disposed in a region (10) of the interior-space end (7), an opening (8), which is closed by a bag-shaped flexible part (11) in order to form a variable pump volume, which is bounded by the housing (3) and the flexible part (11), wherein the air pump (2) is designed in such a way that, in the event of an overpressure caused by surrounding water (22), the flexible part (11) is pressed into the interior space (4), with reduction of the pump volume and bears at least in portions on an inner wall (13) of the housing (3) in a contact portion (12) of the interior space (4), in order to compress air in the pump volume and to supply it from a region (9) of the interior-space beginning (6) via a breathing line (16) to a diver (17), wherein the contact portion (12) extends along the longitudinal axis (5) from the interior-space end (7) in the direction of the interior-space beginning (6) up to a maximum height (18), wherein the flexible part (11) is configured to be pulled out of the interior space (4) against the overpressure by muscle power of the diver (17) and with increase of the pump volume, in order to suck in air via an air-supply line (19) from above a water level (23) of the water (22), wherein furthermore a carrying device (24) for fixation of the air pump (2) in front of the chest of the diver (17) is provided, wherein at least one stiffening element is provided in order to transfer pulling forces that act on the housing during pulling of the flexible part out of the interior space into a region of the pelvis of the diver, wherein the at least one stiffening element is connected to the housing and in an operating condition of the diving apparatus protrudes from the housing in the region of the interior-space end.

* * * * *